US006029972A

United States Patent [19]

Chang

[11] Patent Number: 6,029,972

[45] Date of Patent: Feb. 29, 2000

[54] TOOTHED WHEEL OPERATED ADJUSTING DEVICE FOR CARD STACKING MACHINES

[75] Inventor: Yuan Fong Chang, Taipei, Taiwan

[73] Assignee: Gamemax Corporation, Taipei, Taiwan

[21] Appl. No.: 09/044,139

[22] Filed: Mar. 19, 1998

[51] Int. Cl.[7] ..... B65H 3/52; B65H 1/08; B65H 59/00

[52] U.S. Cl. ..... 271/124; 221/125; 414/797.7

[58] Field of Search ..... 221/124, 125; 414/797.7

[56] References Cited

U.S. PATENT DOCUMENTS

| | | | |
|---|---|---|---|
| 4,961,566 | 10/1990 | Labombarde | 271/35 |
| 5,417,412 | 5/1995 | Vegeals et al. | 271/124 |
| 5,601,282 | 2/1997 | Milo et al. | 271/35 X |
| 5,642,877 | 7/1997 | Green | 271/35 X |
| 5,906,366 | 5/1999 | Chang | 271/124 |

*Primary Examiner*—William E. Terrell
*Assistant Examiner*—Kenneth W Bower
*Attorney, Agent, or Firm*—Smith, Gambrell & Russell, LLP

[57] ABSTRACT

A toothed wheel operated adjusting device for card stacking machines, in particular an adjusting device adapted for telephone cards and the like, including a receiving body, a conveyance device, and a press plate. The receiving body has a main frame and a support seat. The components of the conveyance device are disposed between the main frame and the support seat. The adjusting device has a securing plate formed by directly bending an upper portion of the main frame at an angle of 90 degrees, and a movable adjusting plate at a lower portion thereof. The movable adjusting plate has guide track plates at both sides thereof movably inserted into corresponding guide tracks at both sides of the support seat. The upper surface of the movable adjusting plate is provided with four guide posts fitted with stop springs respectively. An upper end portion of each guide post extends into a corresponding hollow guide hole of the securing seat. An adjusting rotary knob having an adjusting rod secured thereto is inserted via a through hole provided in a lateral side plate of the main frame, with its rear end positioned in a shaft hole of shaft post secured at the other side. When the adjusting rotary knob is turned, teeth of different sizes on the outer circumference of a toothed wheel disposed between the adjusting rotary knob and the shaft post may urge against the upper surface of the movable adjusting plate below according to the turning position, thereby allowing adjustment of a clearance between an inclined surface at the lower portion of the movable adjusting plate and a bottom plate of the support seat to achieve optimal card output.

3 Claims, 7 Drawing Sheets

TOOTHED WHEEL OPERATED ADJUSTING DEVICE FOR CARD STACKING MACHINES

BACKGROUND OF THE INVENTION (a) Field of the Invention

The present invention relates generally to a toothed wheel operated adjusting device for card stacking machines, and more particularly to an adjusting device comprising securing plate extended from an upper portion of a main frame of a receiving body, a movable adjusting plate movably provided at a front end of a support seat are provided, four vertically disposed guide posts fitted with stop springs disposed between the securing plate and the movable adjusting plate, and a wheel having longitudinal teeth of different sizes, whereby when an adjusting rotary knob is turned, the movable adjusting an adjusting rotary knob disposed between the securing plate and the movable plate may displace upwardly and downward to allow adjustment of a card outlet clearance to suit cards of varying thickness.

(b) Description of the Prior Art

Telephone card vending machines are common today. Such vending machines may also be adapted to sell other cards. However, although the thickness of cards is quite uniform, minute difference in thickness may cause blocking or hinder the smooth discharge of cards from the vending machines. A card outlet adjusting device allowing micro-adjustment of the card outlet and of a simple construction is therefore desirable.

The inventor of the present invention has found that little difference in the thickness of cards will directly affect the smooth discharge of cards from card vending machines and conceived the present invention to solve this problem by providing a toothed wheel adjusting device.

SUMMARY OF THE INVENTION

A primary object of the present invention is to provide a toothed wheel operated adjusting device for card stacking machines, in which four guide posts respectively fitted with stop springs are disposed between a securing seat and a movable adjusting plate for balancing and positioning purposes. An adjusting rotary knob having an adjusting rod is connected to a wheel with longitudinal teeth of different sizes to allow adjustment of the upward and downward displacement of the movable adjusting plate, thereby allowing adjustment of a clearance between an inclined surface at the lower portion of the movable adjusting plate and a bottom plate of a support seat. The toothed wheel operated adjusting device according to the present invention is simple in construction and inexpensive to manufacture.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
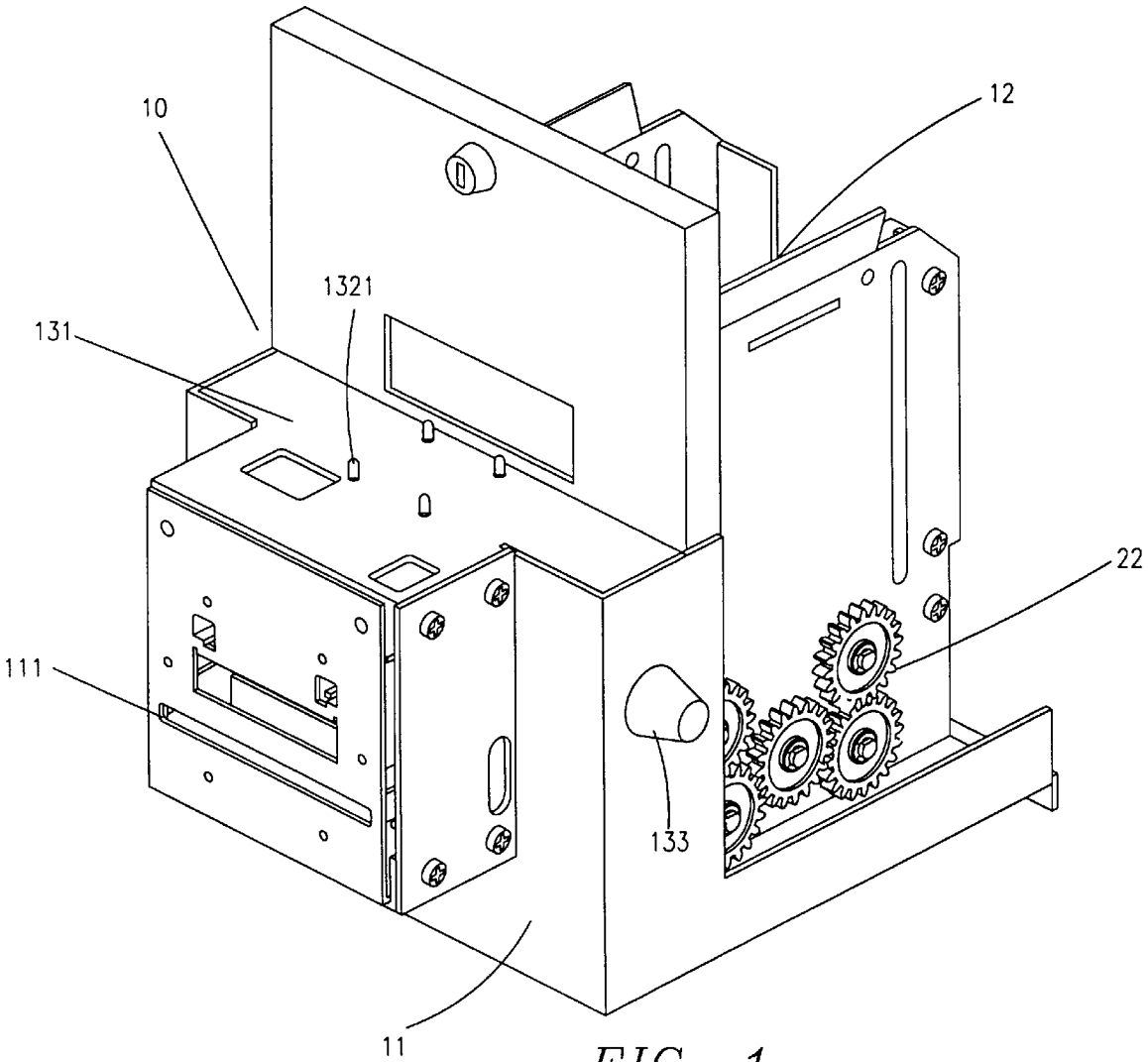
FIG. 1 is a perspective view of the present invention.
Figure 2:
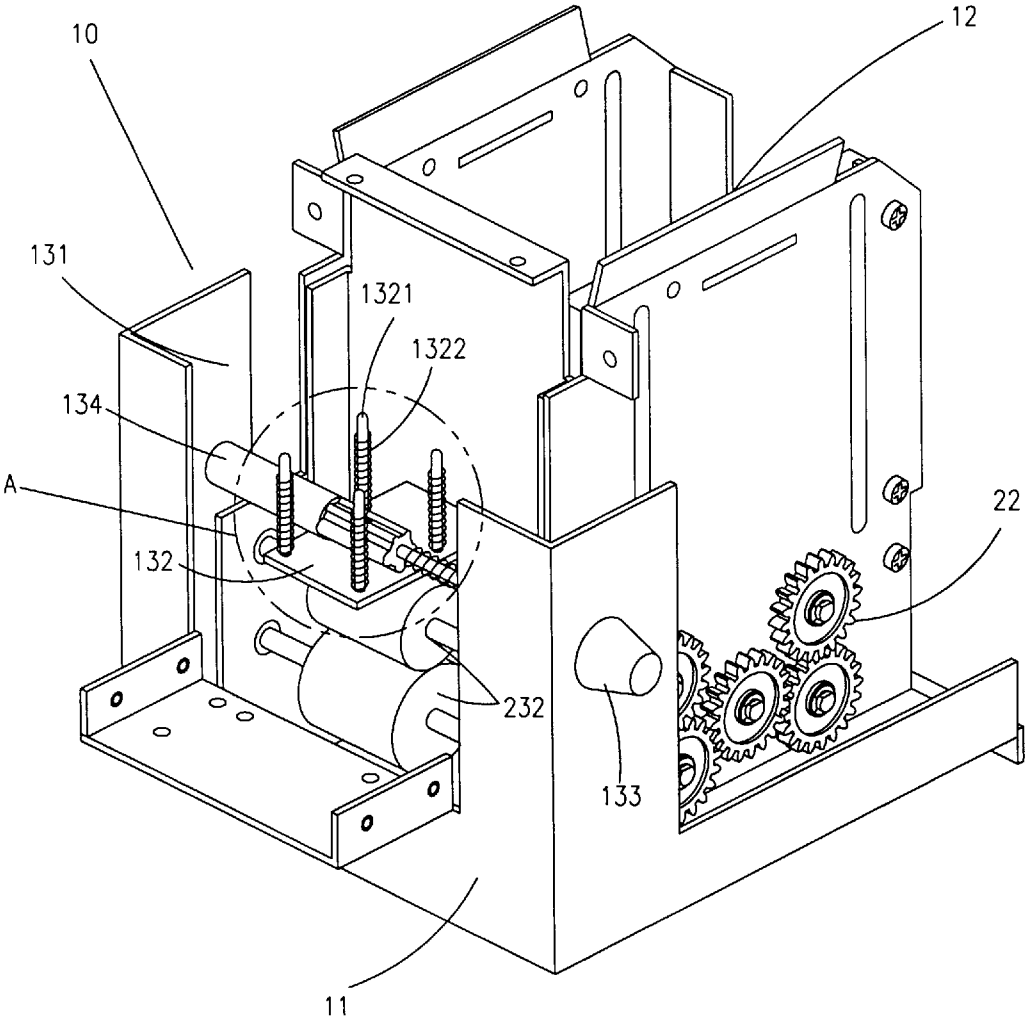
FIG. 2 is a schematic perspective view of an adjusting device in a receiving body of the present invention in part.
Figure 2A:
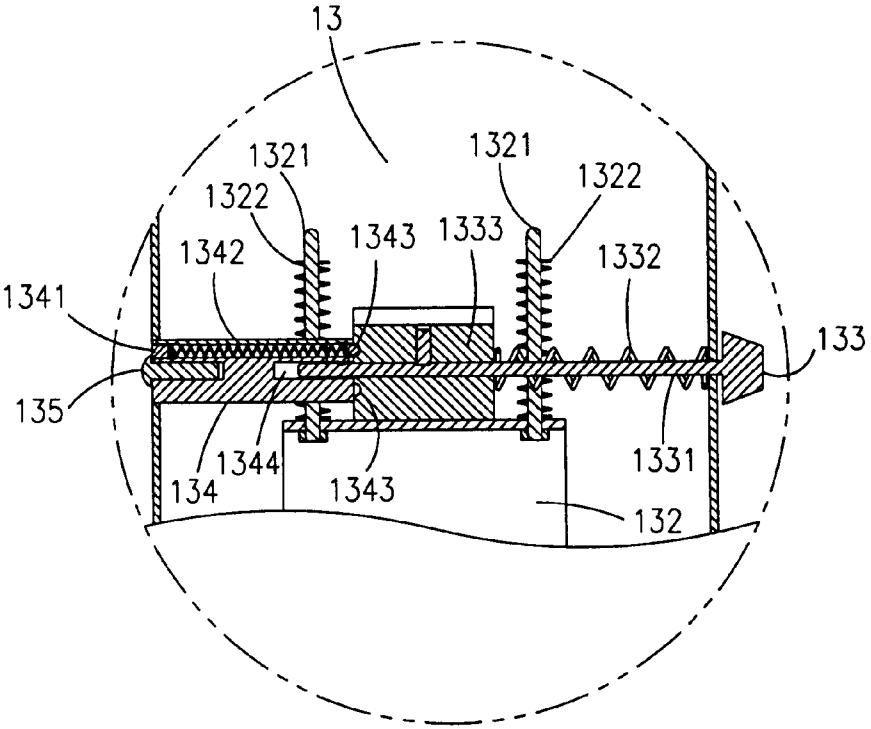
FIG. 2A is an enlarged side view of an adjusting rotary knob and a toothed wheel according to the present invention.
Figure 3:
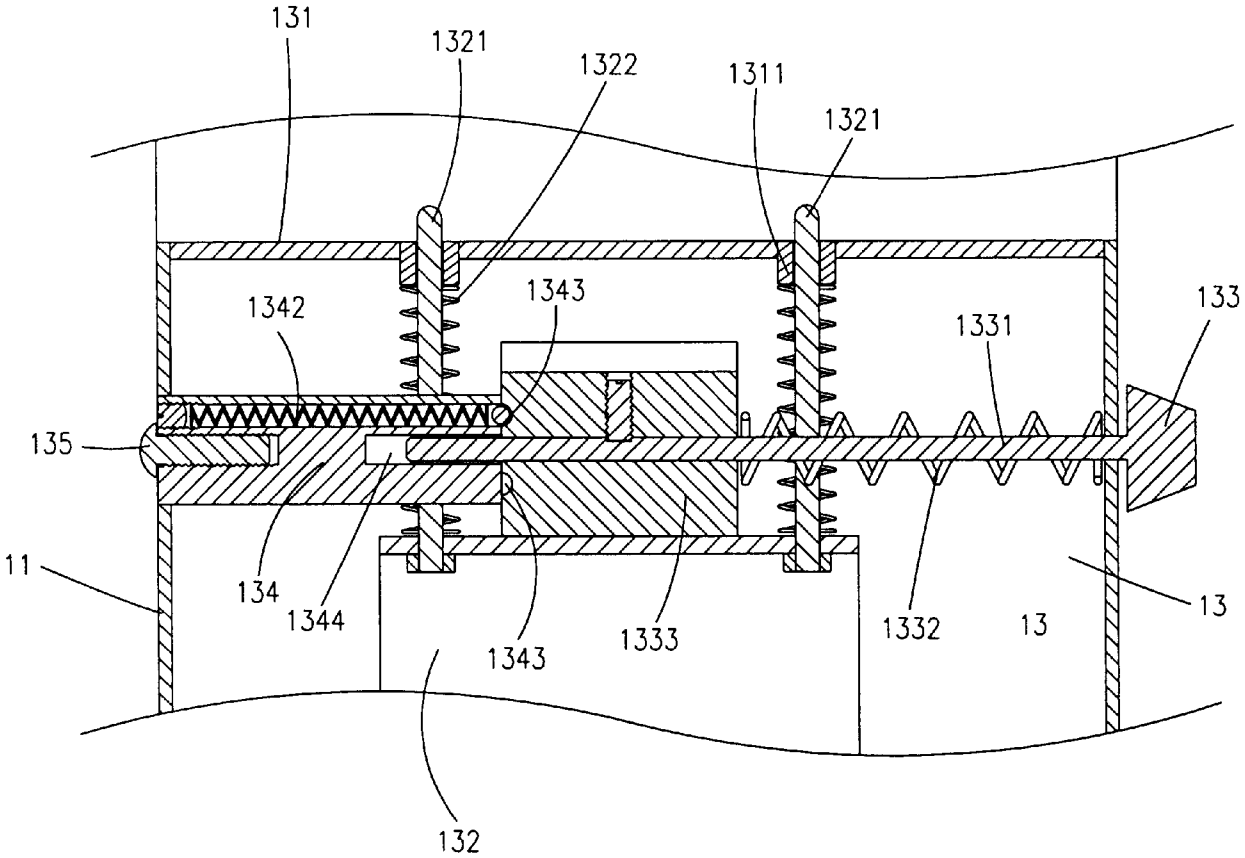
FIG. 3 is a sectional side view illustrating operation of the present invention in part.
Figure 4:
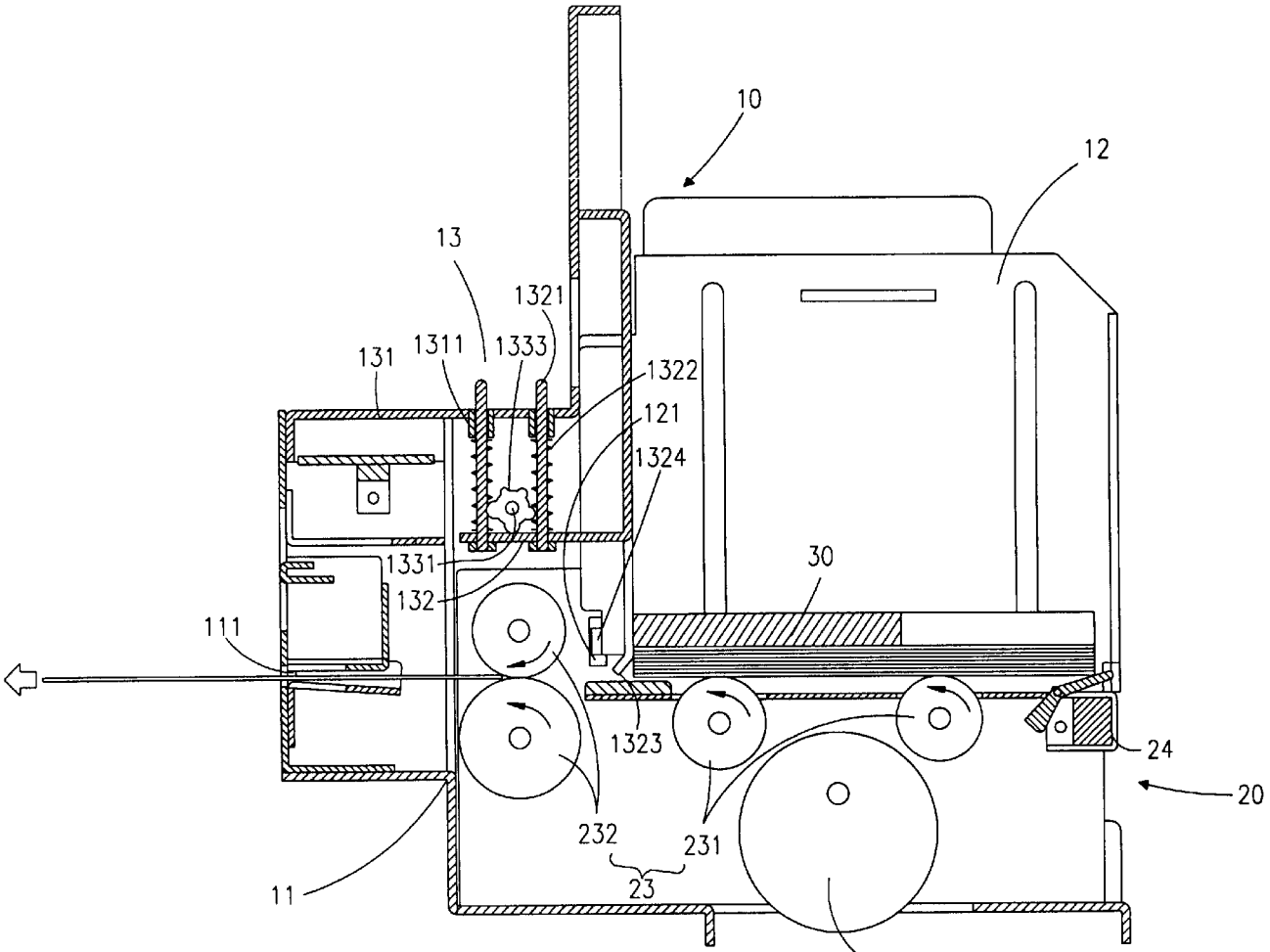
FIG. 4 is a sectional side view of the present invention illustrating operation of the present invention.

With reference to FIGS. 1 and 2, the present invention comprises a receiving body 10 having an L-shaped main frame 11, and a support seat 12 and an adjusting device 13 fixedly provided on an upper side of the receiving body 10. Referring to FIG. 3, the components of a conveyance device 20 are disposed between the main frame 11 and the support seat 12. When cards are placed inside the support seat 12, a press plate is used to exert a downward force thereon to increase the friction between two parallel output rollers and the cards. The structure of the present invention is described in detail hereinafter.

The receiving body 10 includes the above-mentioned main frame 11, the support seat 12 and the adjusting device 13. The front end of the main frame 11 is provided with a card outlet 111. The adjusting device 13 has a securing seat 131 fixedly provided on a faceplate above the card outlet 111. The support seat 12 is fixedly provided on a rear side of the main frame 11. The support seat has a pair of symmetrical guide tracks 121 disposed at the front ends of the lateral plates. The adjusting device 3 has a movable adjusting plate 132 having two guide track plates 1325 respectively inserted into the guide tracks 121 to slidably displace therein. The movable adjusting plate 132 has a planar upper surface to which four vertical guide posts 1321 are welded. Each guide post 1321 is fitted with a stop spring 1322 and has an upper portion fitting into a corresponding hollow guide hole 1311 of the securing seat 131. A bottom side of the movable adjusting plate 32 is an inclined surface 1323. An adjusting rotary knob 133 is passed through a lateral side plate at one side of the main frame 11. The adjusting rotary knob 133 has an adjusting rod 1331 fitted with an abutting spring 1332 one end of which is connected to a toothed wheel 1333 having longitudinal teeth of different sizes thereon, whereas the adjusting rod 1331 passes through the center of the toothed wheel 1333 with its rear end received in a shaft hole 1344 of a shaft post 134. The shaft post 134 is secured to the other lateral side plate of the main frame 11 by means of a screw 136. The interior of the shaft post 134 is provided with a plurality of through slots each of which has a steel ball 1343 and a spring 1342 placed therein in sequence, with a headless bolt 1341 securing their positions. The positions where the steel balls 1343 project from the shaft post 134 face a plurality of semi-circular holes at the rear end of the toothed wheel 1333 to form positioning points.

The conveyance device 20 includes a motor 21, a gear set 22, a roller set 23 and a switch 24. The motor 21 drives the gear set 22 and the roller set 23. The roller set 23 includes conveyor rollers 231 adapted to output cards to a clearance between the two rollers 232 disposed at the front end of the support seat 12. After outputting of the cards is accomplished, the switch 24 may be used to stop the motor 21. As this arrangement is not a technical feature of the present invention, it will not be described in detail herein.

Figure 5:
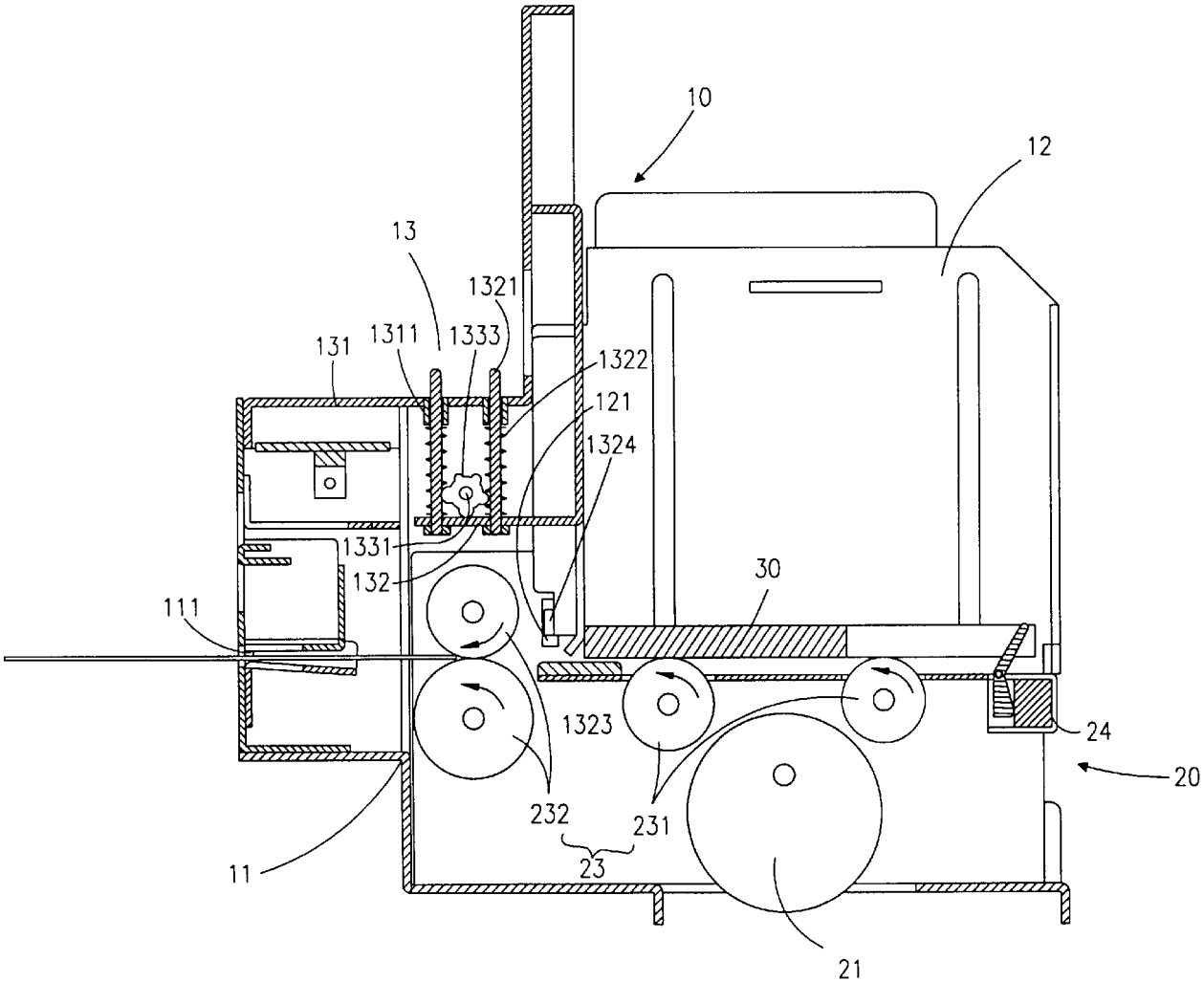
FIG. 5 is a schematic sectional side view illustrating the present invention after conveyance of the cards.
Figure 6:
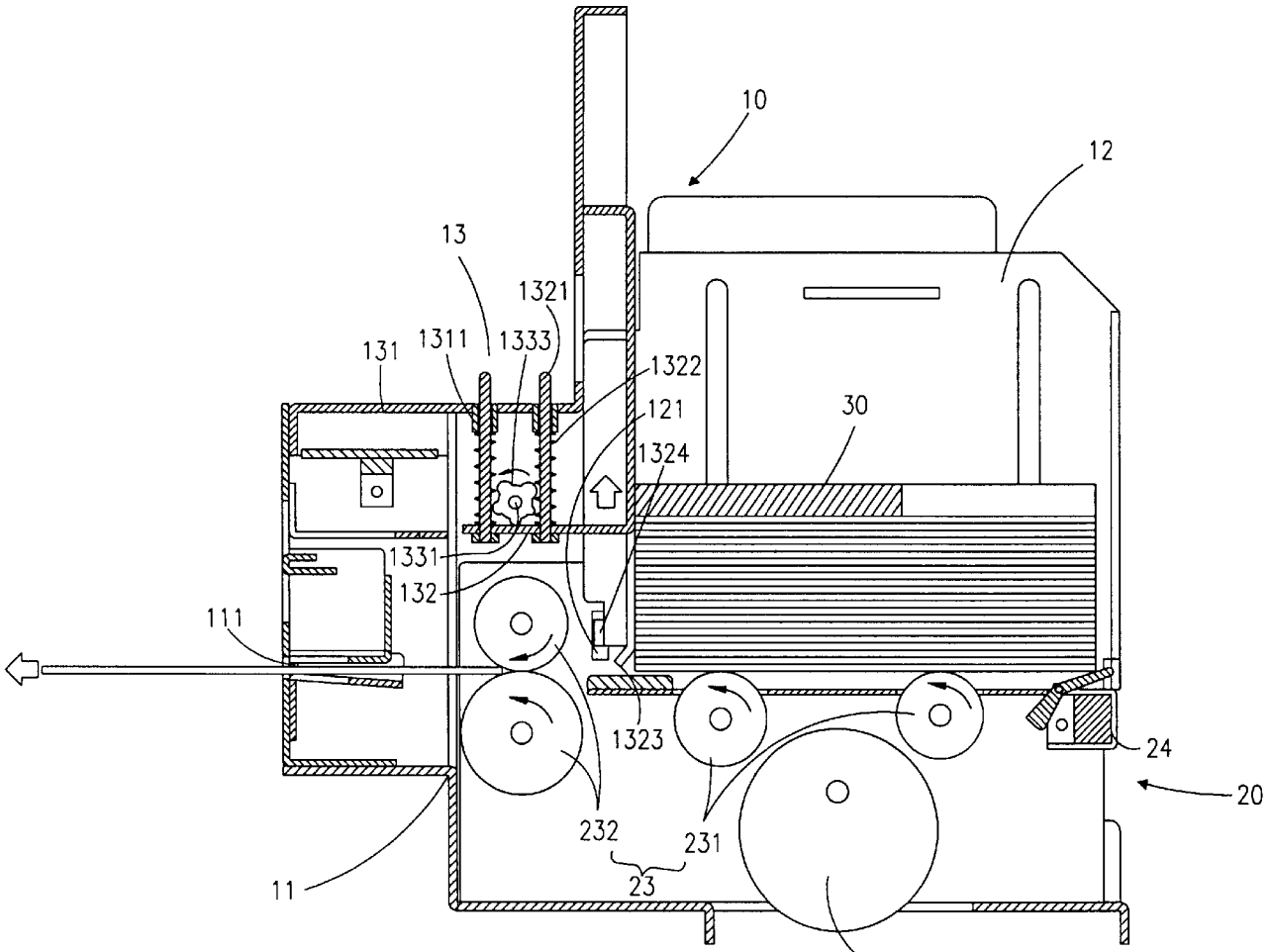
FIG. 6 is a schematic sectional side view illustrating the present invention after adjustment of the clearance.

Referring to FIGS. 2, 3, and 5, when it is desirable to adjust the clearance between the output rollers 232, the adjusting rotary knob 133 of the adjusting device 13 is turned at the position of teeth of a suitable thickness predisposed, with the steel ball 1343 on shaft post 134 at one side engaged in the corresponding semi-circular hole at one side of the toothed wheel 1333. At this point, the four shaft columns 1321 welded to the movable adjusting plate 132 utilize the reset springs 1322 thereon to balance the surrounding pressure. And besides, following the direction of turning of the adjusting rotary knob 133, teeth of different sizes and heights on relative positions of the toothed wheel 1333 are caused to urge against the upper surface of the movable adjusting plate 132 so that the upper portions of the guide posts 1321 displace upwardly and downwardly in the four hollow guide holes 1311 of the securing seat 131, causing the guide track plates 1325 at both sides of the lower portion of the movable adjusting plate 132 to displace in the guide tracks 121 of the support seat 12. At this point, the inclined surface 1324 of the movable adjusting plate 132 and the bottom plate of the support seat 12 will form a clearance adjustable according to a predetermined card thickness. From the aforesaid, it can be appreciated that the present invention is simple in construction and provides an inexpensive design to achieve adjustment of the card outlet clearance according to a predetermined card size.

Furthermore, with reference to FIGS. 2 and 3, the present invention is characterized in that the outer circumference of the toothed wheel 133 is provided with a plurality of longitudinal teeth, the height of each tooth being configured according to actual needs so as to adapt to the thickness of cards. The teeth work in cooperation with to the securing seat 131 fixed at the upper side of the main frame 11 and the movable adjusting plate 132 insertably positioned in the guide tracks 121 at both sides of the support seat 12. Besides, the four guide posts 1321 on the upper surface of the movable adjusting plate 132 and their stop springs 1322 enable the toothed wheel 1333 to utilize the teeth of varying sizes to cause the movable adjusting plate 132 to displace a certain angle so that the clearance between the inclined surface 1324 and the bottom plate of the support seat 12 may be adjusted. In addition, the abutting spring 1332 is provided between the toothed wheel 1333 and the lateral side plate of the main frame 11 at the inner side of the adjusting rotary knob 133 to provide a checking force, whereas the arrangement of the headless bolts 1341, springs 1342 and steel balls 1343 provided in the shaft post 134 to match the semicircular holes corresponding formed at the rear end of the toothed wheel 1333 allows positive positioning by means of the elastic steel balls 1343. It can therefore be seen that the present invention is simple in construction and inexpensive to manufacture.

The longitudinal teeth on the toothed wheel 1333 may vary in number, size, and height depending on different card thickness. Besides, the number of the teeth on the toothed wheel 1333 may be increased or decreased so that the present invention may be adapted for use on various types of cards at the same time.

Although the present invention has been illustrated and described with reference to the preferred embodiment thereof, it should be understood that it is in no way limited to the details of such embodiment but is capable of numerous modifications within the scope of the appended claims.

What is claimed is:

1. A toothed wheel operated adjusting device for card stacking machines, comprising a receiving body, a conveyance device, and a press plate, said receiving body including a main frame and a support seat, the components of said conveyance device being disposed between said main frame and said support seat, wherein said adjusting device is disposed at an upper portion of said receiving body and includes a securing seat formed by directly bending an upper portion of said main frame at an angle of 90 degrees, and a movable adjusting plate at a lower portion thereof, said movable adjusting plate having two guide track plates at both sides of a lower portion thereof which are movably inserted into corresponding guide tracks of two lateral side plates of said support seat and positioned therein, said movable adjusting plate further having four guide posts fixedly provided on an upper surface thereof, each of said guide posts being fitted with a stop spring and having an upper end portion extending into a corresponding hollow guide hole of said securing seat, an adjusting rotary knob being provided at an outer side of said main frame and an adjusting rod being secured to an inner side of said adjusting rotary knob, said adjusting rod being externally fitted with an abutting spring one end of which abutting one end of a toothed wheel, said adjusting rod being passed through the center of said toothed wheel with a rear end thereof positioned in a shaft hole of a shaft post, said toothed wheels having a plurality of longitudinal teeth of different sizes provided on an outer circumference thereof, whereby when said adjusting rotary knob of said adjusting device is turned, said teeth on said toothed wheel secured on said adjusting rod will urge against the upper surface of said movable adjusting plate below and said four guide posts on said movable adjusting plate will utilize said stop springs thereof to achieve balance; and by turning the adjusting rotary knob in different directions, the teeth of different sizes will cause said upper end portions of said guide posts to displace upwardly and downwardly in said hollow guide holes of said securing seat, simultaneously causing said guide track plates at both sides of said movable adjusting plate to displace in said guide tracks of said support seat, so that a clearance of a predetermined size is formed between an inclined surface at the lower side of said movable adjusting plate and a bottom plate of said support seat, thereby achieving simple adjustment of a card outlet clearance for cards of a predetermined size.

2. A toothed wheel adjusting device for card stacking machines as defined in claim 1, wherein said shaft post of said adjusting device is provided with a plurality of through holes therein, each of said through holes receiving a steel ball and a spring, which are secured by means of a headless bolt such that a portion of said steel ball projecting from said through hole and being provided with an elastic checking force.

3. A toothed wheel adjusting device for card stacking machines as defined in claim 1 or 2, wherein said toothed wheel is provided with a plurality of holes facing said steel balls exposed on one side of said shaft post of said adjusting device, said holes of said turning wheel matching said through holes of said shaft post in number, whereby the elastic checking force of said steel balls is used to ensure positive positioning of the turning positions of said toothed wheel.

* * * * *